US007395140B2

(12) United States Patent
Christie et al.

(10) Patent No.: US 7,395,140 B2
(45) Date of Patent: Jul. 1, 2008

(54) GEOGRAPHIC INFORMATION SYSTEM AND METHOD FOR MONITORING DYNAMIC TRAIN POSITIONS

(75) Inventors: W. Brian Christie, Allison Park, PA (US); James Rudakewiz, Gibsonia, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 314 days.

(21) Appl. No.: 10/789,593

(22) Filed: Feb. 27, 2004

(65) Prior Publication Data

US 2005/0192720 A1 Sep. 1, 2005

(51) Int. Cl.

| | |
|---|---|
| ***G06F 17/00*** | (2006.01) |
| ***G06G 7/76*** | (2006.01) |
| ***G08G 1/123*** | (2006.01) |
| ***B61L 27/00*** | (2006.01) |
| ***B61L 25/00*** | (2006.01) |

(52) U.S. Cl. ..... 701/19; 701/117; 701/208; 701/300; 340/990; 340/995.14; 246/2 R; 246/20; 246/122 R

(58) Field of Classification Search ..... 701/19, 701/20, 117, 201, 207, 208, 209, 300; 340/988, 340/989, 990, 992, 995.1, 995.14, 995.27; 246/1 R, 2 R, 111, 20, 122 R, 124
See application file for complete search history.

(56) References Cited

U.S. PATENT DOCUMENTS 4,896,580 A * 1/1990 Rudnicki ..... 89/1.815
5,173,691 A * 12/1992 Sumner ..... 340/905
5,214,757 A 5/1993 Mauney et al.
5,565,858 A 10/1996 Guthrie
5,758,313 A 5/1998 Shah et al.
5,836,529 A * 11/1998 Gibbs ..... 246/122 R
5,904,727 A 5/1999 Prabhakaran
5,922,040 A 7/1999 Prabhakaran
5,948,040 A 9/1999 DeLorme et al.

(Continued)

OTHER PUBLICATIONS

Virginia Railway Express, "VRE Service Disruptions Information", http://www.vre.org.trainbrain/disrupt.shtml, Apr. 13, 2001, pp. 1-2.

(Continued)

*Primary Examiner*—Jack Keith
*Assistant Examiner*—Edward Pipala
(74) *Attorney, Agent, or Firm*—Kirk D. Houser; Eckert Seamans Cherin & Mellott, LLC

(57) ABSTRACT

A geographic information system (GIS) displays geographic roadway data, geographic track data and geographic train position data. The GIS includes a GIS database having static roadway and track data. A computer aided dispatching (CAD) system includes a task to determine an occupied track section. A web server includes a first routine determining geographic starting and ending positions of the track section, a second routine displaying geographic information regarding the static roadway and track data, and a third routine determining geographic information regarding the occupied track section from the geographic starting and ending positions of the track section and from the GIS database. A client system communicates with the web server to receive and display the geographic information regarding the static roadway and track data, and to receive and display the geographic information regarding the occupied track section with the geographic information regarding the static roadway and track data.

30 Claims, 8 Drawing Sheets

U.S. PATENT DOCUMENTS

| | | | | |
|---|---|---|---|---|
| 6,081,769 | A * | 6/2000 | Curtis | 702/158 |
| 6,148,291 | A | 11/2000 | Radican | |
| 6,218,961 | B1 * | 4/2001 | Gross et al. | 340/903 |
| 6,263,265 | B1 * | 7/2001 | Fera | 701/19 |
| 6,529,722 | B1 | 3/2003 | Heinrich et al. | |
| 6,641,090 | B2 * | 11/2003 | Meyer | 246/122 R |
| 6,650,998 | B1 * | 11/2003 | Rutledge et al. | 701/211 |
| 6,751,549 | B1 * | 6/2004 | Kozak | 701/209 |
| 6,766,248 | B2 * | 7/2004 | Miyahara | 701/208 |
| 6,865,454 | B2 * | 3/2005 | Kane et al. | 701/19 |
| 6,871,137 | B2 * | 3/2005 | Scaer et al. | 701/200 |
| 2002/0010531 | A1 * | 1/2002 | Hawthorne et al. | 701/19 |
| 2003/0236598 | A1 | 12/2003 | Antelo et al. | |
| 2004/0010432 | A1 | 1/2004 | Matheson et al. | |
| 2004/0182969 | A1 * | 9/2004 | Kane et al. | 246/20 |
| 2005/0209770 | A1 * | 9/2005 | O'Neill et al. | 701/117 |
| 2006/0074544 | A1 * | 4/2006 | Morariu et al. | 701/117 |

OTHER PUBLICATIONS

THETRIP.COM, "FlightTRACKER", http://www.trip.com/trs/trip/flighttracker/flight_tracker_home.xsl, Apr. 2, 2001, pp. 1-2.

THETRIP.COM, "FlightTRACKER", http://www.trip.com/trs/trip/flighttracker/flight_tracker_graphic.xsl, Apr. 26, 2001, pp. 1-2.

Houston Transtar, "Sugar Land Rail Monitoring System", http://traffic.tamu.edu/rail/about_rail.aspx, Aug. 18, 2003, 3 pp.

Korte, George B., "The GIS Book", OnWord Press, Fifth Edition, 2001, pp. 17-21, 24-26.

* cited by examiner

NODE FILE

| | |
|---|---|
| N1 | XY |
| N2 | XY |
| N3 | XY |
| N4 | XY |
| N5 | XY |
| N6 | XY |
| N7 | XY |
| N8 | XY |
| N9 | XY |
| N10 | XY |

AREA FILE

| | | |
|---|---|---|
| A1 | XY | (OUTSIDE) |
| A2 | XY | L1, L4, L7, L8, L3 |
| A3 | XY | L2, L5, L6, L4 |
| A4 | XY | L8, L9, L12, L11 |
| A5 | XY | L6, L10, L13, L9, L7 |

LINE FILE

| LINE | START NODE | END NODE | AREA LEFT | AREA RIGHT | GEOMETRY |
|---|---|---|---|---|---|
| L1 | N1 | N2 | A1 | A2 | XY,XY |
| L2 | N2 | N3 | A1 | A3 | XY,XY |
| L3 | N1 | N6 | A2 | A1 | XY,XY |
| L4 | N2 | N4 | A3 | A2 | XY...XY |
| L5 | N3 | N5 | A1 | A3 | XY,XY |
| L6 | N4 | N5 | A3 | A5 | XY...XY |
| L7 | N4 | N7 | A5 | A2 | XY...XY |
| L8 | N6 | N7 | A2 | A4 | XY...XY |
| L9 | N7 | N9 | A5 | A4 | XY...XY |
| L10 | N5 | N10 | A1 | A5 | XY,XY |
| L11 | N6 | N8 | A4 | A1 | XY,XY |
| L12 | N8 | N9 | A4 | A1 | XY,XY |
| L13 | N9 | N10 | A5 | A1 | XY,XY |

172

*FIG. 9*
PRIOR ART

GEOGRAPHIC INFORMATION SYSTEM AND METHOD FOR MONITORING DYNAMIC TRAIN POSITIONS

BACKGROUND OF THE INVENTION

1. Field of the Invention

The present invention relates to information systems and, more particularly, to geographic information systems for monitoring train positions. The invention also relates to methods for monitoring train positions with a geographic information system.

2. Background Information

Municipal authorities in cities have experienced problems with trains blocking crossings when dispatching emergency vehicles (e.g., police; fire; ambulance). This is not conducive, for example, to good railroad/municipal authority relationships.

In the case of railroads, train traffic may temporarily interrupt or block local transportation routes at the time when emergency vehicles are dispatched. This problem has become increasingly important with the advent of relatively longer trains and more frequent trains coupled with increased vehicular traffic. Due to the overall impact of this aggregate of changes, local civil authorities have concerns for their citizens. Hence, they are demanding more information about train movements within, and in the vicinity of, their communities.

The quality of emergency response systems depends upon, among other things, the time it takes to locate the emergency and the time it takes an emergency response team to reach the corresponding location. These factors are coupled to the extent that the time to reach the site of the emergency depends, in part, upon where the site is located and upon the best route to that site.

Although normal railroad graphics are very familiar to railroad personnel, such graphics are very difficult for a lay (i.e., non-railroad) person (e.g., a civil emergency dispatcher) to understand.

It is known to employ a web user interface including a representation of a rail corridor that depicts crossing status (e.g., crossing is clear; crossing is blocked; lack of data) using a color-coded icon and that depicts trains in the corridor with icons that exist at an approximate location of a train. The interface automatically updates every three minutes to provide monitoring capability for fire, emergency medical services and police who all may experience disruptions from delays at grade crossings.

There is room for improvement in systems and methods for monitoring train positions.

SUMMARY OF THE INVENTION

There is a need for the railroads to provide a system, which superimposes railroad train operating displays with displays from a geographic information system.

These needs and others are met by the present invention, which determines a track section occupied by a train, determines geographic starting and ending positions of the occupied track section, and displays geographic information regarding the occupied track section with other geographic information regarding, for example, static track data and/or static roadway data.

As one aspect of the invention, a method for displaying geographic track data and geographic position data for a train comprises: employing a geographic information system database; entering static track data in the geographic information system database; determining a track section occupied by the train; determining geographic starting and ending positions of the track section; displaying geographic information regarding the static track data from the geographic information system database; determining geographic information regarding the track section occupied by the train from the geographic starting and ending positions of the track section and from the geographic information system database; and displaying the geographic information regarding the track section occupied by the train with the geographic information regarding the static track data.

The method may include storing representations of a plurality of track sections in a first non-geographically based track layout database associated with the computer aided dispatching system; and storing geographical coordinates associated with each of the track sections in a second database.

The method may include employing as the second database a track infrastructure database; including in the track infrastructure database a plurality of records, with one of the records being associated with a corresponding one of the track sections; and including with each of the records a record identifier, an identifier of the corresponding one of the track sections, a starting latitude, a starting longitude, an ending latitude and an ending longitude of the corresponding one of the track sections.

As another aspect of the invention, a method for displaying geographic roadway data, geographic track data, and geographic position data for a train comprises: employing a geographic information system database; entering static roadway data in the geographic information system database; entering static track data in the geographic information system database; determining a track section occupied by the train; determining geographic starting and ending positions of the track section; displaying geographic information regarding the static roadway data and the static track data from the geographic information system database; determining geographic information regarding the track section occupied by the train from the geographic starting and ending positions of the track section and from the geographic information system database; and displaying the geographic information regarding the track section occupied by the train with the geographic information regarding the static roadway data and the static track data.

The method may include storing a starting longitude, a starting latitude, an ending longitude and an ending latitude for each of the track sections in another database; and determining geographic information regarding the track section occupied by the train from the starting longitude, the starting latitude, the ending longitude and the ending latitude of the track section occupied by the train and from the geographic information system database.

The method may include determining another track section occupied by the train; determining geographic starting and ending positions of such another track section; determining geographic information regarding such another track section occupied by the train from the geographic starting and ending positions of such another track section and from the geographic information system database; and displaying the geographic information regarding such another track section occupied by the train.

The method may include responding to an event defined by such determining another track section occupied by the train; and displaying in about real-time the geographic information regarding such another track section occupied by the train.

In accordance with a preferred practice, the method may clear another track section to be occupied by the train; determine as a cleared track section such another track section; determine geographic starting and ending positions of the cleared track section; determine geographic information regarding the cleared track section from the geographic starting and ending positions of the cleared track section and from the geographic information system database; and display the geographic information regarding the cleared track section with the displayed geographic information regarding the track section occupied by the train.

In accordance with a preferred practice, the method may plan a further track section to be occupied by the train; determine as a planned track section the further track section to be occupied by the train; determine geographic starting and ending positions of the planned track section; determine geographic information regarding the planned track section from the geographic starting and ending positions of the planned track section and from the geographic information system database; and display the geographic information regarding the planned track section with the displayed geographic information regarding the track section occupied by the train and with the displayed geographic information regarding the cleared track section.

The method may include determining when the train moves within a geographic area corresponding to a train position layer of the geographic information system database and responsively entering the dynamically determined geographic information in the train position layer of the geographic information system database.

The method may include determining as a cleared track section another track section cleared to be occupied by the train at a future time; and displaying geographic information regarding the cleared track section with the geographic information regarding the track section occupied by the train.

The method may include determining as a planned track section a further track section planned to be occupied by the train at another future time; and displaying geographic information regarding the planned track section with the geographic information regarding the cleared track section and the geographic information regarding the track section occupied by the train.

As another aspect of the invention, a geographic information system for displaying geographic roadway data, geographic track data, and geographic position data for a train comprises: a geographic information system database including static roadway data and static track data; means for determining a track section occupied by the train; means for determining geographic starting and ending positions of the track section; means for displaying geographic information regarding the static roadway data and the static track data from the geographic information system database; means for determining geographic information regarding the track section occupied by the train from the geographic starting and ending positions of the track section and from the geographic information system database; and means for displaying the geographic information regarding the track section occupied by the train with the geographic information regarding the static roadway data and the static track data.

As another aspect of the invention, a geographic information system for displaying geographic roadway data, geographic track data, and geographic position data for a train comprises: a geographic information system database including static roadway data and static track data; a computer aided dispatching system comprising means for determining a track section occupied by the train; a server comprising: a first routine adapted to determine geographic starting and ending positions of the track section, a second routine adapted to display geographic information regarding the static roadway data and the static track data from the geographic information system database, and a third routine adapted to determine geographic information regarding the track section occupied by the train from the geographic starting and ending positions of the track section and from the geographic information system database; a communication network; and a client system adapted to communicate with the server over the communication network, to receive and display the geographic information regarding the static roadway data and the static track data, and to receive and display the geographic information regarding the track section occupied by the train with the geographic information regarding the static roadway data and the static track data.

The computer aided dispatching system may include means for determining a cleared track section to be occupied by the train. The first routine may be further adapted to determine geographic starting and ending positions of the cleared track section. The third routine may further be adapted to determine geographic information regarding the cleared track section from the geographic starting and ending positions of the cleared track section and from the geographic information system database. The client system may further be adapted to receive and display the geographic information regarding the cleared track section to be occupied by the train with the geographic information regarding the track section occupied by the train.

The computer aided dispatching system may further include means for determining a planned track section to be occupied by the train. The first routine may further be adapted to determine geographic starting and ending positions of the planned track section. The third routine may further be adapted to determine geographic information regarding the planned track section from the geographic starting and ending positions of the planned track section and from the geographic information system database. The client system may further be adapted to receive and display the geographic information regarding the planned track section to be occupied by the train with the geographic information regarding the cleared track section to be occupied by the train and with the geographic information regarding the track section occupied by the train.

BRIEF DESCRIPTION OF THE DRAWINGS

A full understanding of the invention can be gained from the following description of the preferred embodiments when read in conjunction with the accompanying drawings in which:

FIG. 9 is a block diagram showing GIS data files and records.

DESCRIPTION OF THE PREFERRED EMBODIMENTS

As employed herein, the term "track section" shall expressly include, but not be limited by, a segment, section or other portion of a railway track or railroad; or a segment, section or other portion of a track that is controlled and/or monitored by a circuit, such as, for example, a track circuit.

Figure 1:
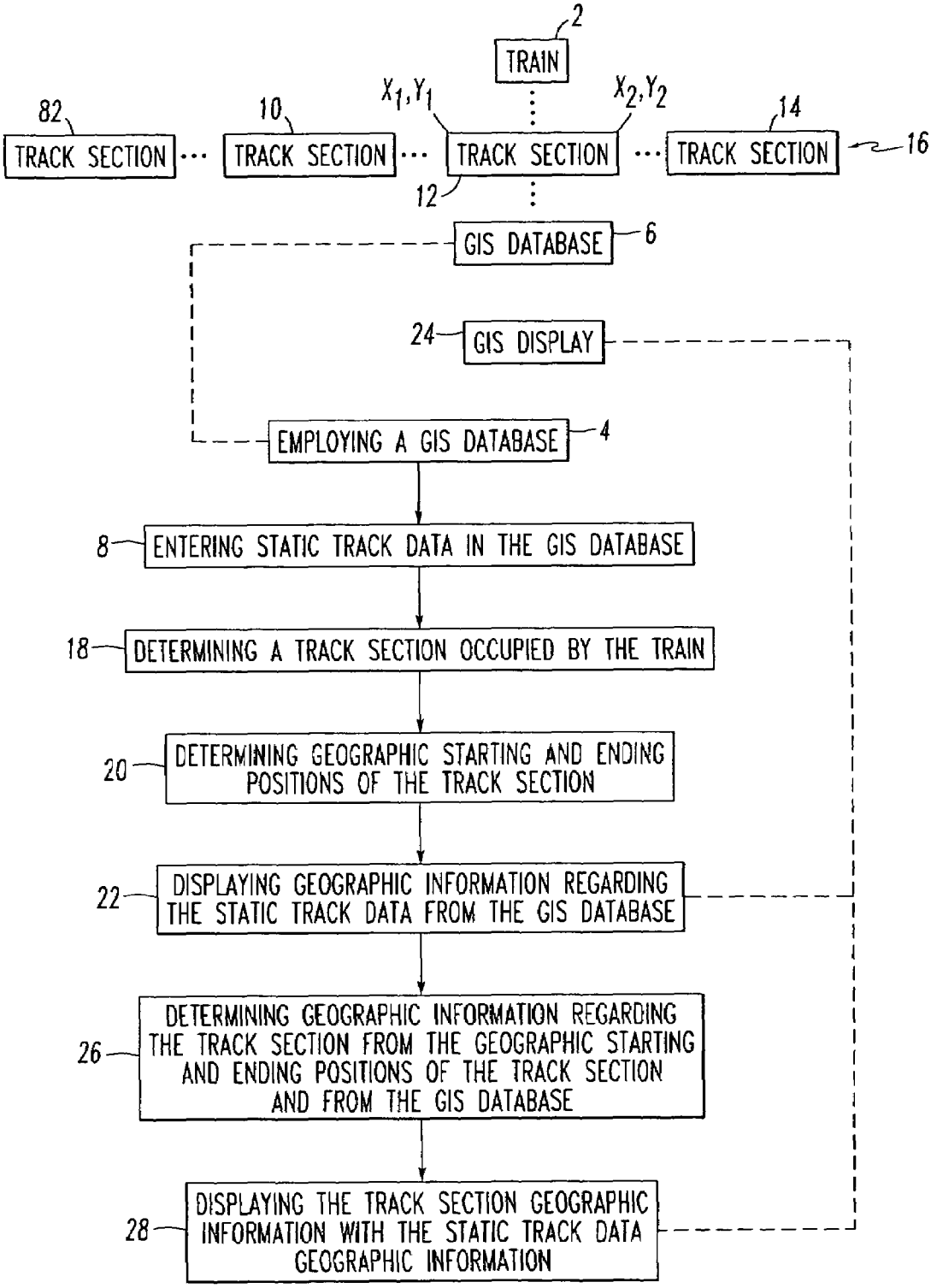
FIG. 1 is a flowchart of a method in accordance with the present invention.

Referring to FIG. 1, a flowchart shows a method for displaying geographic track data and geographic position data for a train, such as 2. The method employs, at 4, a geographic information system (GIS) database 6. Then, at 8, static track data is entered in the GIS database 6. This information may include, for example, geographic information describing a plurality of track sections 10, 12, 14, 82 of a railroad 16. Next, at 18, one or more track sections, such as track section 12, which is occupied by the train 2, is determined. Then, at 20, geographic starting and ending positions (e.g., $x_1$, $y_1$; $x_2$, $y_2$) of the track section 12 are determined. Next, at 22, geographic information regarding the static track data from the GIS database 6 is displayed (e.g., on a GIS display 24). Then, at 26, geographic information regarding the track section 12 occupied by the train 2 is determined from the geographic starting and ending positions of the track section 12 and from the GIS database 6. Finally, at 28, geographic information regarding the track section 12 occupied by the train 2 is displayed on the GIS display 24 with the geographic information regarding the static track data.

Figure 2:
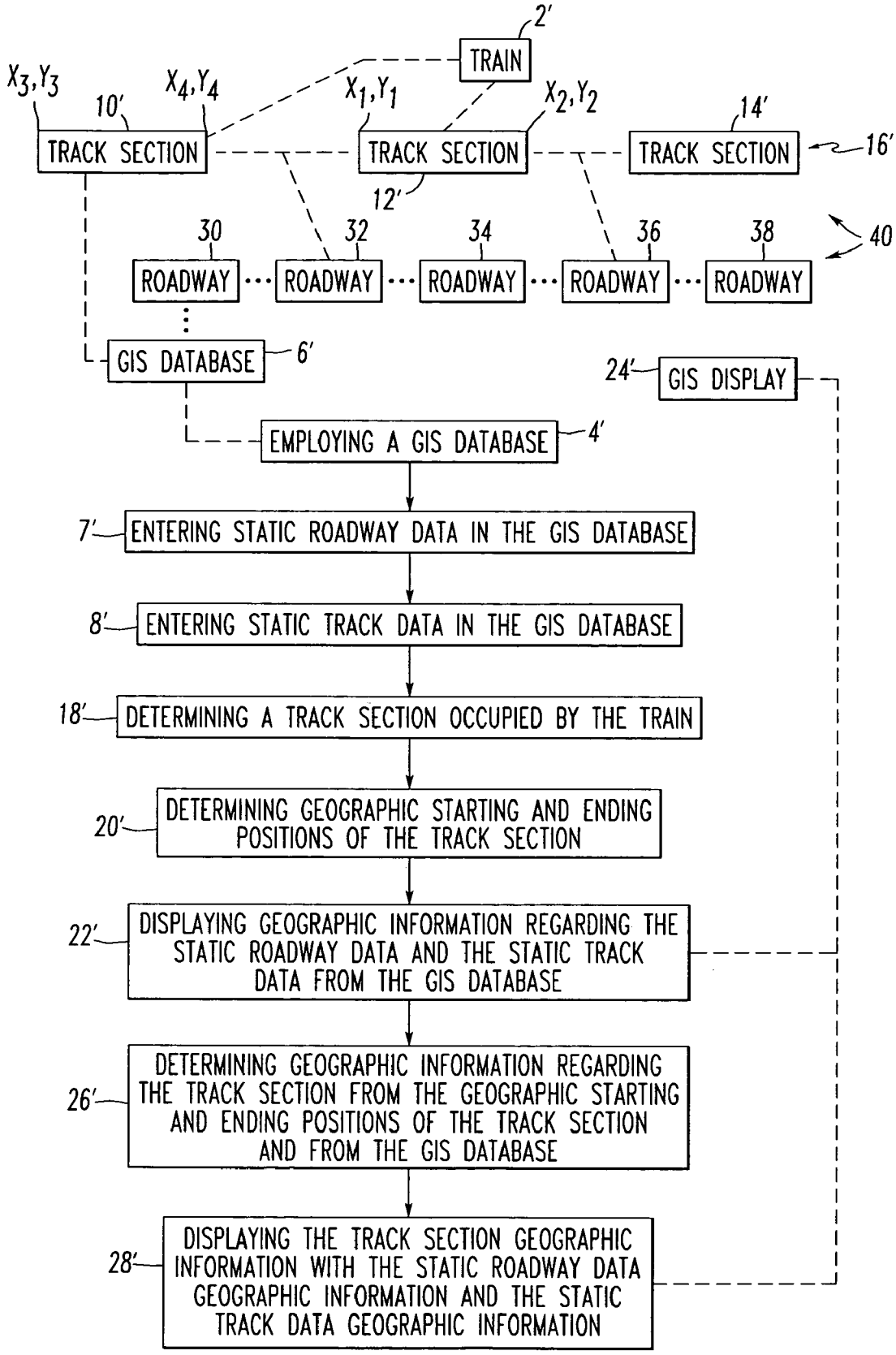
FIG. 2 is a flowchart of a method in accordance with another embodiment of the invention.

FIG. 2 illustrates a flowchart showing a method for displaying geographic roadway data, geographic track data and geographic position data for a train, such as 2'. The method employs, at 4', a GIS database 6'. At 7', static roadway data is entered in the GIS database 6'. This information may include, for example, geographic information describing a plurality of roadways 30, 32, 34, 36, 38 of a geographic location, such as a municipality 40, which also includes a plurality of track sections 10', 12', 14' of a railroad 16'. Then, at 8', static track data is entered in the GIS database 6'. This information may include, for example, geographic information describing the track sections 10', 12', 14'. Next, at 18', one or more track sections, such as track sections 10',12', which are occupied by the train 2' are determined. Then, at 20', geographic starting and ending positions (e.g., $x_3$, $y_3$; $x_4$, $y_4$ and $x_1$, $y_1$; $x_2$, $y_2$) of the track sections 10', 12' are determined. Next, at 22', geographic information regarding the static roadway data and the static track data from the GIS database 6' is displayed (e.g., on a GIS display 24'). Then, at 26', geographic information regarding the one or more track sections 10', 12' occupied by the train 2' is determined from the geographic starting and ending positions of those track sections 10', 12' and from the GIS database 6'. Finally, at 28', geographic information regarding the one or more track sections 10', 12' occupied by the train 2' is displayed on the GIS display 24' with the geographic information regarding the static roadway data and the static track data.

EXAMPLE 1

Figure 3:
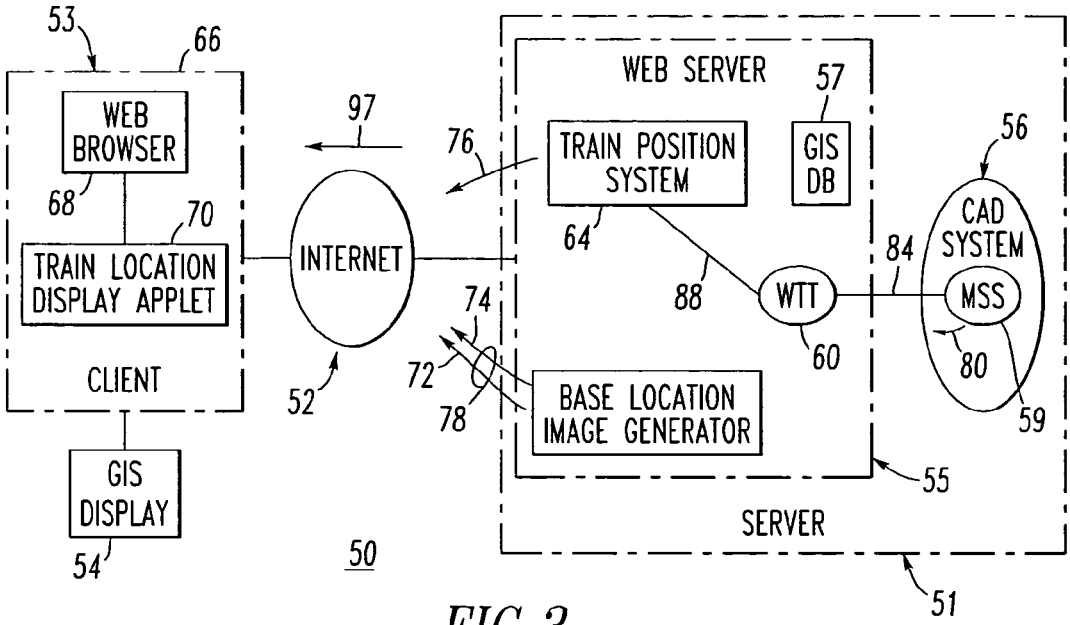
FIG. 3 is a block diagram of a geographic information system (GIS) in accordance with another embodiment of the invention.

FIG. 3 shows a geographic information system (GIS) 50 including a server system 51, a communication network, such as the Internet 52, and a client system 53. The GIS 50 displays geographic roadway data, geographic track data, and geographic position data for a train, such as 2 of FIG. 1, on a GIS display 54 of the client system 53. Although the Internet 52 is shown, any suitable communication network (e.g., without limitation, a local area network (LAN); a wide area network (WAN); intranet; extranet; global communication network; wireless local area network (WLAN); wireless personal area network (WPAN)) may be employed.

The server system 51 includes a web server 55 and a Computer Aided Dispatching (CAD) system 56. The web server 55 includes a geographic information system (GIS) database (GIS DB) 57 including static roadway data and static track data. The CAD system 56 includes a routine 58 for determining one or more track sections occupied by one or more trains. An MSS task 59 transports that information to the web server 55. The web server 55 further includes a first routine, such as WTT 60, adapted to determine geographic starting and ending positions of the occupied track section(s); a second routine, such as a base location image generator 62, adapted to display geographic information regarding the static roadway data and the static track data from the GIS database 57; and a third routine, such as train position system 64, adapted to determine geographic information regarding the occupied track section(s) from the geographic starting and ending positions of the occupied track section(s) and from the GIS database 57.

The client system 53 is adapted to communicate with the server system 51 over the Internet 52, in order to receive and display on the GIS display 54 the geographic information regarding the static roadway data and the static track data, and to receive and display the geographic information regarding the occupied track section(s) with the geographic information regarding the static roadway data and the static track data. The client system 53 includes a suitable processor, such as personal computer (PC) 66, although any suitable processor (e.g., without limitation, computer; workstation) may be employed. The PC 66 includes a web browser 68, which runs a train location display applet 70, that, in turn, connects via the Internet 52 to the web server 55.

The base location image generator 62 provides static roadway infrastructure data 72 and static track data 74 in the vicinity of a municipality of interest, such as 40 of FIG. 2. The base location image generator 62 is a commercially available GIS software package, such as, for example, ArcGIS marketed by ESRI of Redlands, Calif.; or MapX marketed by Mapinfo of Rochester, N.Y. In turn, the train position system 64 produces a train position overlay 76 to a base location image 78 generated by the image generator 62.

The CAD system 56 is the source of train position information 80. The CAD system 56 provides the actual train position information 80 based on indication data from track devices (not shown) associated with the track sections 10, 12, 14, 82 of FIG. 1. The CAD system 56 is marketed by the assignee of the invention, Union Switch & Signal, Inc. of Pittsburgh, Pa. Although the CAD system 56 is shown, a wide range of control systems are employed by railroads to control the movements of trains on their individual properties or track infrastructures. Variously known as Computer-Aided Dispatching systems, Operations Control Systems (OCS), Network Management Centers (NMC) and Central Traffic Control (CTC) systems, such systems automate the process of controlling the movements of trains traveling across a track infrastructure, whether it involves traditional fixed block control or moving block control assisted by a positive train control system. Hence, a wide range of systems may be employed to provide the train position information 80.

The train position information 80 includes the one or more tracks, such as track section 12 of FIG. 1, that a train, such as train 2, is occupying.

Furthermore, as is discussed below in connection with FIGS. 5 and 6, the CAD system 56 may also provide the one or more tracks, such as track section 10 of FIG. 1, that the train is cleared to occupy; and the one or more tracks, such as track section 82, that the train is planned to occupy. The tracks that a train is occupying are managed from a train tracking subsystem (not shown) of the CAD system 56. The tracks that a train is cleared to occupy are managed from a traffic control subsystem (not shown) of the CAD system 56. The tracks that a train is planned to occupy are managed from a planning subsystem (not shown) of the CAD system 56.

Alternatively, actual and predicted data may be provided from a system, such as the CAD system 56, with a planning component (not shown) (e.g., providing tactical planning (e.g., Autorouting) and/or strategic planning (e.g., an optimized traffic planner).

The message switching server (MSS) task 59 of the CAD system 56 receives train position information (e.g., occupied; cleared; planned) from such CAD system and forwards this information 80 to the web translation task (WTT) 60 over a suitable interface, such as an intranet 84. The WTT 60 takes the train position information 80 and translates it to geographic coordinates suitable for display by the PC GIS display 54 in the form of a GIS map, such as the GIS map 86 of FIG. 7. The train position information 80 includes the tracks, which the train is currently occupying, cleared to occupy, and/or planned to occupy. The WTT 60, in turn, finds the starting latitude/longitude point of the occupied track section and the ending latitude/longitude point of that track section. The starting and ending track section points are sent to the train position system 64 over a suitable interface 88 (e.g., a socket-based communication protocol used to transmit data between two processes (e.g., processes executing on the same processor; processes executing on different processors); routine-to-routine messages; an intranet).

Figure 7:
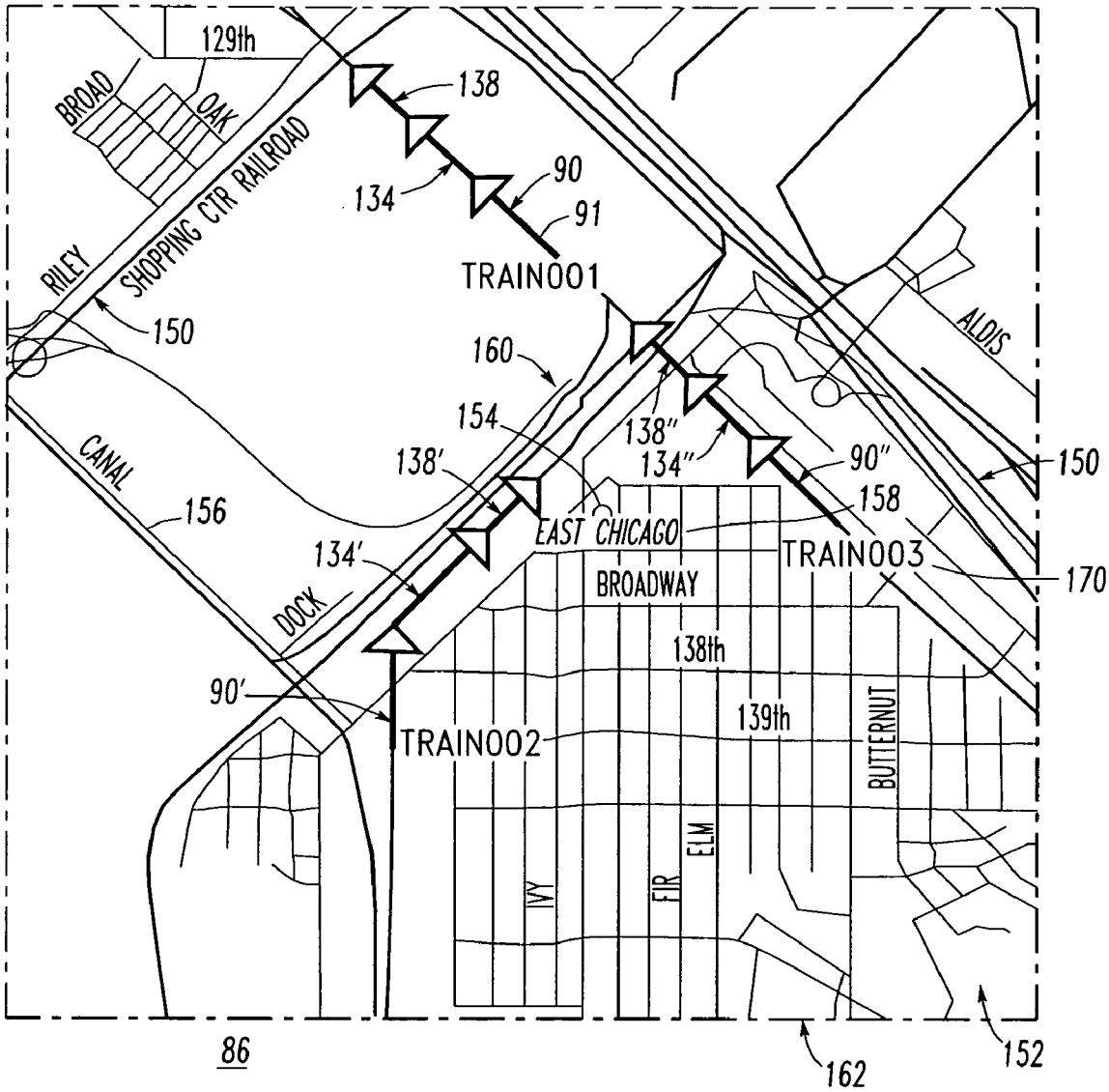
FIG. 7 is a representation of a train, track and roadway GIS display for the GIS of FIG. 3.

As will be described in greater detail, below, in connection with FIGS. 4, 7 and 8, a train position layer feature, such as 90 of FIG. 7, is added to the GIS map 86 (FIG. 7) by tracing between the starting and ending geographic points of the occupied track section 91 in a railroad layer 92 of the GIS database 94 of FIG. 8. The updated train position feature 90 is sent as a streaming vector 97 over the Internet 52 to the train location display applet 70, which runs on the web browser 68. The train location display applet 70, in turn, applies the streaming vector train position feature 90 to the displayed GIS map 86.

The train position system 64 of FIG. 3 maintains a copy of the current train position features 90, 90', 90" (FIG. 7) in the memory (not shown) of the web server 55. Each of these train position features 90 (for Train001), 90' (for Train002) and 90" (for Train003) takes the form of, for example, a vector projected onto the GIS map 86 of FIG. 7.

Figure 8:
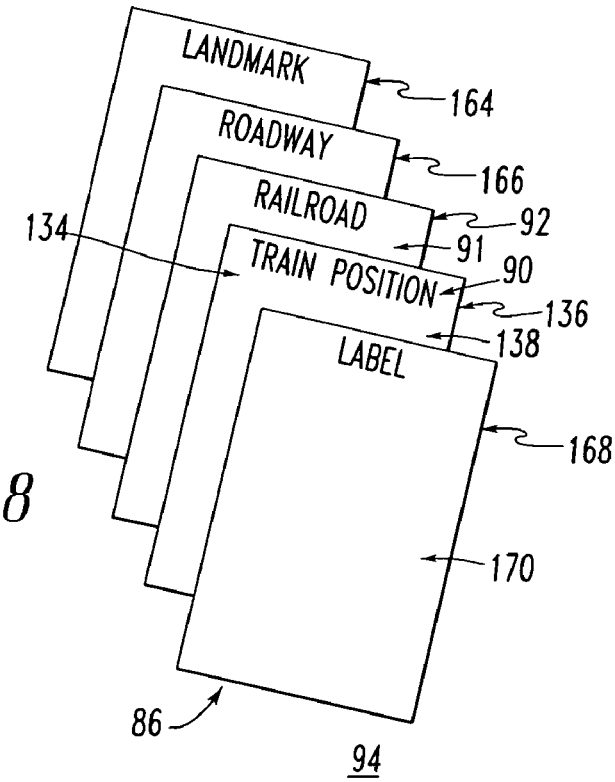
FIG. 8 is a block diagram of a GIS database in accordance with another embodiment of the invention.

The train position system 64 also maintains an in-memory copy of the railroad track layer 92 of FIG. 8. The railroad track layer 92 is used to map from starting/ending latitude/longitude points (e.g., 118 of FIG. 4) to the geographic representation (e.g., 90 of FIG. 7) of the occupied railroad track sections, such as 12 of FIG. 1. This in-memory copy is maintained with, for example, Map Objects for Java marketed by ESRI of Redlands, Calif.; or MapXtreme Java Edition marketed by MapInfo of Rochester, N.Y.

EXAMPLE 2

Figure 4:
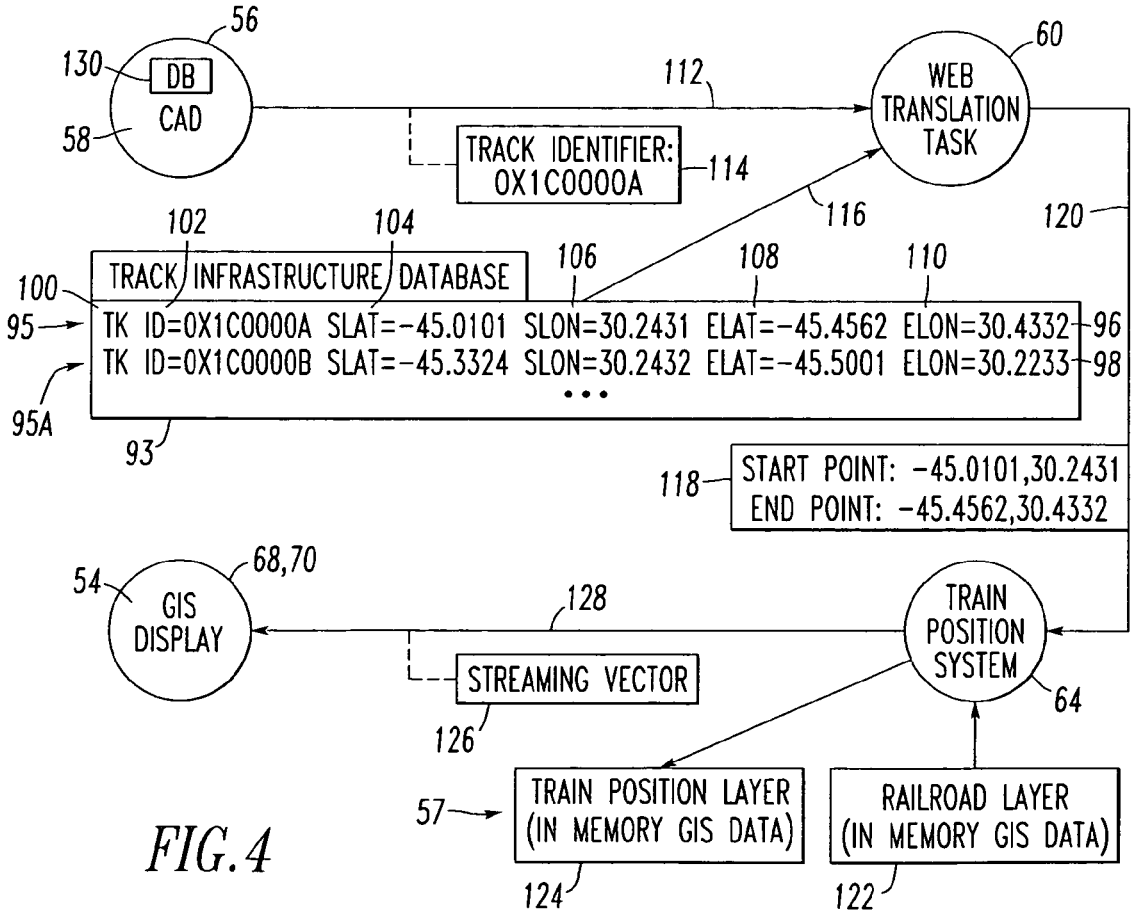
FIGS. 4-6 are block diagrams of various data transformations employed by the GIS of FIG. 3 in accordance with other embodiments of the invention.

FIG. 4 shows example data transformations for track section occupancy (e.g., current or present train position) of the GIS 50 of FIG. 3 and the train position system 64, which converts information from a track infrastructure database 93 to GIS coordinates. The track infrastructure database 93 contains the configuration of a plurality of track circuits, such as 95,95A, associated with corresponding track sections, such as the track sections 10, 12, 14, 82 of the railroad 16 (FIG. 1) to be controlled or monitored. The track infrastructure database 93 includes a plurality of configuration records, such as 96, 98, describing each of the track circuits 95, 95A, respectively. Each of these records, such as 96, includes a record identifier (TK) 100 and a track identifier (ID) 102. The record 96 also includes fields for starting latitude (SLAT) 104, starting longitude (SLON) 106, ending latitude (ELAT) 108, and ending longitude (ELON) 110 of the corresponding track section. These fields are employed, as discussed below in connection with FIG. 7, to project the track section endpoints onto the GIS map 86. Although example longitude and latitude values (e.g., degrees) are shown, any suitable geographic coordinates may be employed (e.g., without limitation, relative longitude and latitude values; relative X and Y distances; actual X and Y distances from a known coordinate; milepost distances from a known coordinate).

Whenever an event occurs in which a train occupies a different track section, the routine 58 of the CAD system 56 sends through the MSS task 59 a track occupancy message 112 including a track identifier 114 to the web translation task (WTT) 60. The track occupancy message 112 is sent from the CAD system 56 responsive to a train occupying a track section. The CAD system 56 sends such messages 112 for all trains on any track section that is controlled and/or monitored by such CAD system. Preferably, the train position system 64 maintains one or more GIS maps (e.g., bounded by three or more (e.g., four) longitude/latitude nodes), such as GIS map 86 of FIG. 7, for corresponding portion(s) of corresponding geographic region(s) associated with the CAD system 56. The identifier 114 of the occupied track section is sent in the track occupancy message 112. The WTT 60 employs the track identifier 114 (e.g., 0xC0000A in this example) as a key to find the matching track configuration record 96 in the track infrastructure database 93. In turn, the four corresponding starting and ending latitude and longitude values 104, 106, 108, 110 are retrieved by the WTT 60 from a track configuration message 116 and are sent, as shown at 118, to the train position system 64 in a train position message 120.

The train position system 64 uses the starting and ending latitude and longitude points 118 from the train position message 120 to search railroad layer GIS data 122. The railroad layer GIS data 122 is an in-memory copy of railroad graphic coordinates in the format of GIS data files and records (FIG. 9). This railroad layer GIS data 122 corresponds to the railroad layer 92 of the GIS database 94 of FIG. 8. The train position system 64 searches the railroad layer GIS data 122 for one or more railroad track features (e.g., of the occupied track section) between the two starting and ending latitude and longitude points 118. The train position system 64, in turn, collects one or more graphic points (e.g., nodes) between the starting and ending points in the GIS data 122, in order to create and store the feature 90 (FIG. 7) (e.g., a straight line; a curved line formed by a plurality of straight lines; another path between two points) in a train position layer GIS data 124. For example, the train position system 64 determines a plurality of nodes between a first node defined by the starting longitude and the starting latitude, and a second node defined by the ending longitude and the ending latitude of the occupied track section.

The train position layer GIS data 124 is preferably stored in memory, in order that client requests for new GIS displays (e.g., 54 of FIG. 3) can be serviced more quickly.

The feature 90, in a format corresponding to the GIS data files and records (FIG. 9), in turn, is sent as a streaming vector 126 in a GIS train position message 128 to the train location display applet 70, which runs from the web browser 68. The train position feature 90 is preferably indicated by a suitably designated (e.g.; uniquely colored; blue) line with arrowhead as shown in FIG. 7. For example, the applet 70 employs suitable GIS viewer software or library functions to display the feature 90 on the GIS map 86. This displays the feature 90, which is defined by both the two starting and ending latitude and longitude points 118 and by the nodes from the GIS database 94 (FIG. 8) for the geographic information of the occupied track section.

The CAD system 56 preferably stores representations of a plurality of track sections in a first non-geographically based track layout database (DB) 130. The CAD system 56 does not make use of the geographical coordinates 104, 106, 108, 110 associated with each of those track sections in the track infrastructure database 93.

It will be appreciated that the MSS task 59, WTT 60, train position system 64 and applet 70 cooperate to respond to new events, such as, for example, where the same train occupies a different track section or where another train first occupies a track section. Hence, another sequence of messages 112, 116, 120, 128 responsively causes an efficient update of the features 90, 90', 90" of the GIS map 86 (FIG. 7) in near real-time for communications over the Internet 52. Although multiple routines 59, 60, 64, 70 in different processors are shown, the invention is applicable to one or more routines in the same or different processors.

EXAMPLE 3

Preferably, the train position system 64 determines when a train moves within a geographic area corresponding to a train position layer 136 of the GIS database 94 of FIG. 8 and responsively enters the dynamically determined geographic information (e.g., the vector defined by the points 118) in that layer 136. For example, the GIS database 94 may correspond to one GIS map 86, which is bounded by known, predetermined geographic coordinates.

EXAMPLE 4

Alternatively, the GIS database 94 may include a plurality of different GIS maps including, for example, the GIS map 86, with each of such maps being bounded by known, predetermined geographic coordinates for corresponding geographic areas. In this example, by employing the starting and ending track points 118 of the train position message 120, and the geographic coordinates of the GIS maps, the train position system 64 determines which one or more of the various GIS maps is (are) associated with those track points 118. Those GIS maps include one or more track sections that are currently occupied by the train. The train position system 64 uses the railroad layer 92 (FIG. 8) of the corresponding GIS map(s) to find the track sections of the railroad between the starting and ending track points 118.

EXAMPLE 5

Figure 5:
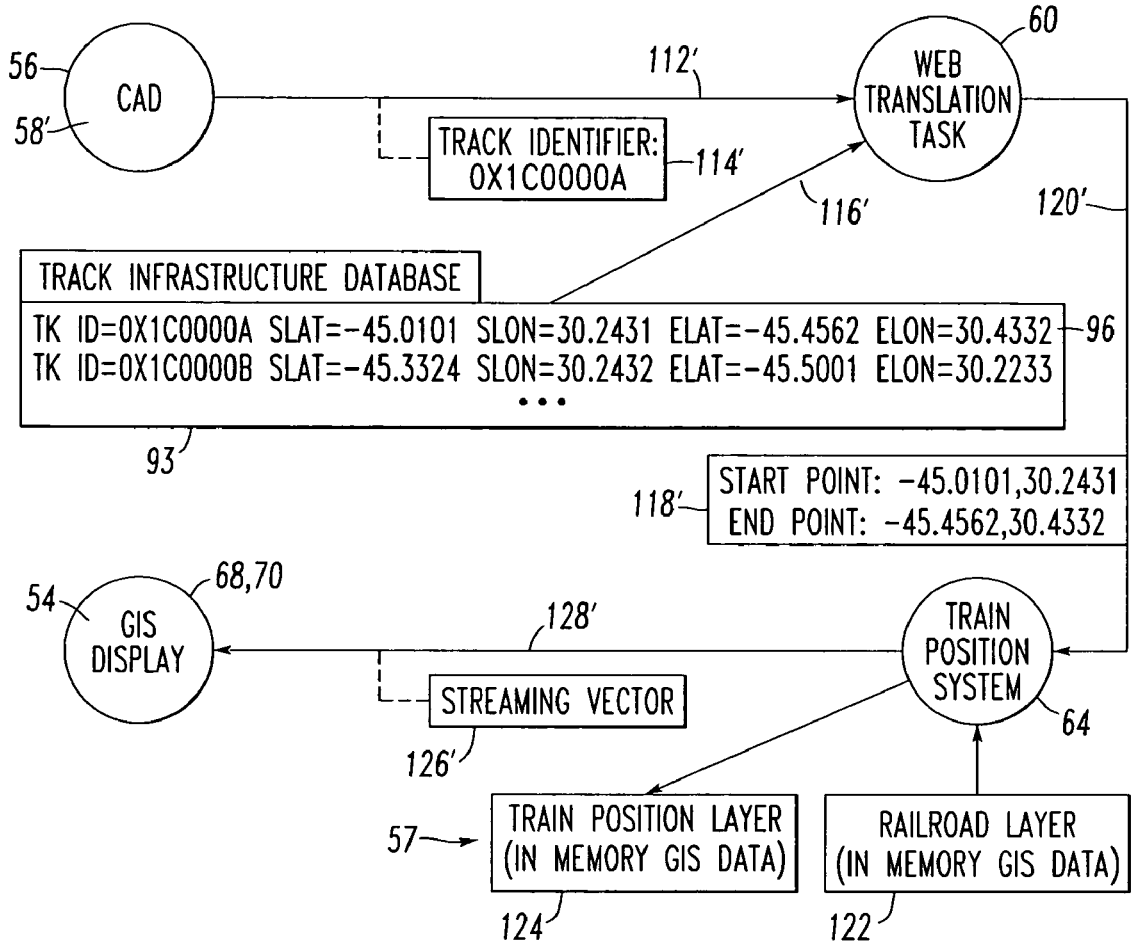

As shown by FIG. 5, the track sections on which a train is cleared to operate can also be displayed by features, such as 134, on the GIS map 86 of FIG. 7. The CAD system 56 determines as cleared track sections one or more track sections that are cleared to be occupied by the train at a future time. FIG. 5 is similar to FIG. 4, except that different messages 112', 116', 120', 128' are employed between the CAD system 56, WTT 60, train position system 64 and applet 70 for data transformations associated with a track section, such as 10, being cleared for a train, such as 2 of FIG. 1, by the CAD system 56.

First, a CTC subsystem task 58' of the CAD system 56 sends a track clear message 112' through the MSS task 59 (FIG. 3) to the web translation task 60. The web translation task 60 employs a track identifier 114' in the track clear message 112' as a key to find the matching track record 96 in the track infrastructure database 93. In turn, the four corresponding starting and ending latitude and longitude values of the track section corresponding to the track identifier 114' are retrieved by the WTT 60 from a track configuration message 116' and are sent, as shown at 118', to the train position system 64 in a train clear message 120'. These data transformations are similar to the transformations for track occupancy as was discussed above in connection with FIG. 4. The points 118' are the starting and ending points of the one or more cleared track sections. The train position system 64 uses the starting and ending points to find the graphic representation of the cleared track sections in the railroad layer GIS data 122. From the graphic representation of the cleared track sections, the feature 134 is built (along with the feature 90 of FIG. 4) on the train position layer 136 of the GIS database 94 of FIG. 8. The feature 134 is saved to the train position layer GIS data 124 and is sent as a streaming vector 126' in a GIS train cleared position message 128' to the train location display applet 70. The train cleared position feature 134 is preferably represented by a suitably designated (e.g.; uniquely colored; yellow arrowhead) and line in FIG. 7.

EXAMPLE 6

Figure 6:
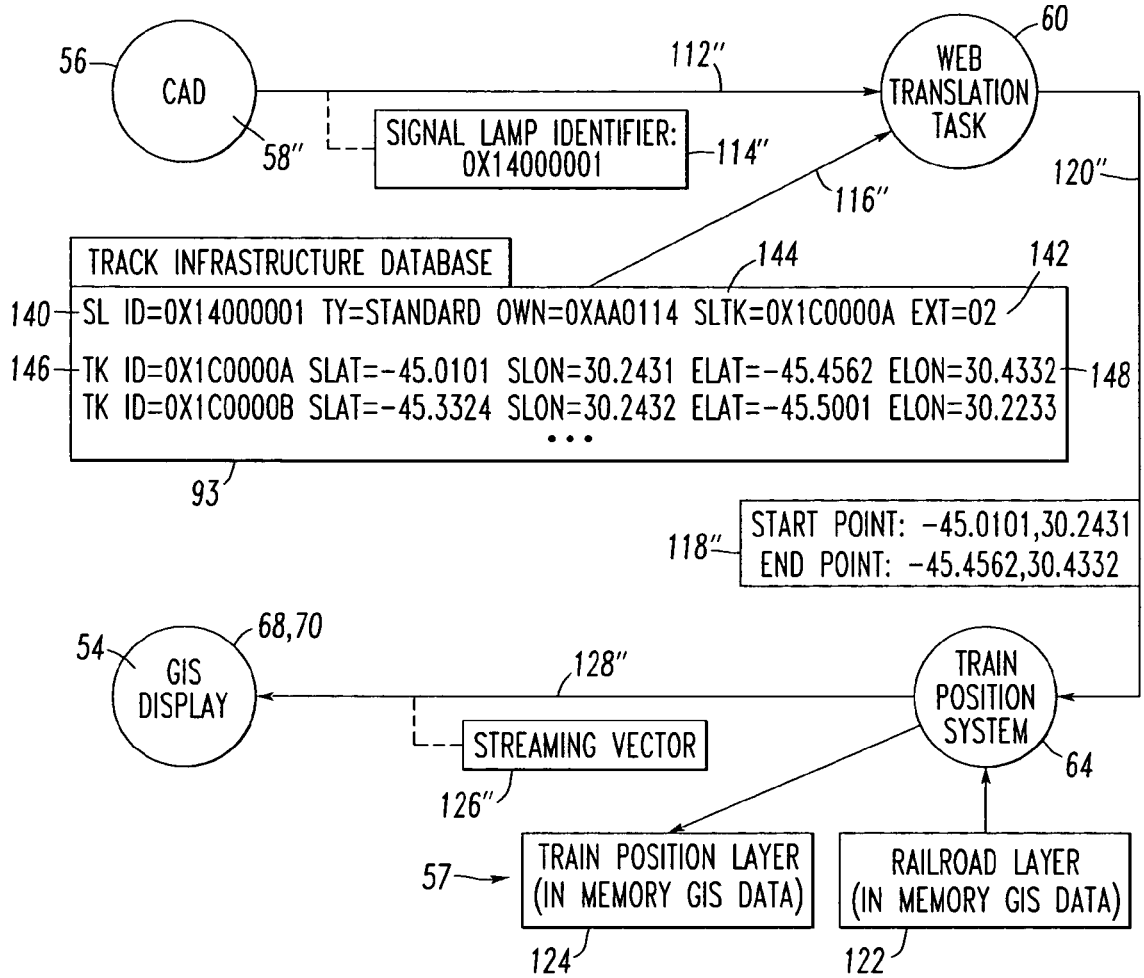

As shown by FIG. 6, the track sections on which a train is planned to operate can also be displayed by features, such as 138, on the GIS map 86 of FIG. 7. The CAD system 56 determines one or more signal lamps for one or more corresponding track sections that are planned to be occupied by the train at a future time. FIG. 6 is similar to FIG. 4, except that different messages 112", 116", 120", 128" are employed between the CAD system 56, WTT 60, train position system 64 and applet 70 for data transformations associated with a track section, such as 82, being planned for a train, such as 2 of FIG. 1, by the CAD system 56.

First, a planning subsystem task 58" of the CAD system 56 sends a signal lamp planned message 112" through the MSS task 59 (FIG. 3) to the web translation task 60. The signal lamp planned message 112" contains an identifier 114" (e.g., 0x14000001 in this example) of a signal lamp 140 that a train is planned to pass. The web translation task 60 uses the identifier 114" to find the matching signal lamp record 142 in the track infrastructure database 93. The signal lamp (SL) records, such as 142, contain an identifier (SLTK) 144 (e.g., 0x1C0000A in this example) of a track circuit 146 associated with the signal lamp 140. The SLTK identifier 144 is used to find the matching track section record 148 in the track infrastructure database 93.

In turn, the four corresponding starting and ending latitude and longitude values of the track section corresponding to the track identifier 144 are retrieved by the WTT 60 from a track configuration message 116" and are sent, as shown at 118", to the train position system 64 in a train planned message 120". These data transformations are similar to the transformations for track occupancy as was discussed above in connection with FIG. 4. The points 118" are the starting and ending points of the one or more planned track sections. The train position system 64 uses the starting and ending points to find the graphic representation of the planned track sections in the railroad layer GIS data 122. From the graphic representation of the planned track sections, the feature 138 is built (along with the features 90, 134 of FIG. 7) on the train position layer 136 of the GIS database 94 of FIG. 8. The feature 138 is saved to the train position layer GIS data 124 and is sent as a streaming vector 126" in a GIS train planned position message 128" to the train location display applet 70. The train planned position feature 138 is preferably represented by a suitably designated (e.g.; uniquely colored; magenta arrowhead) and line in FIG. 7.

As will be appreciated from FIG. 7, the features 90, 134, 138 (e.g., for Train001) accurately and in near real-time show the current, cleared and planned positions of that train with respect to the track and roadway geographic information of the GIS map 86. Similarly, the features 90', 134', 138' (e.g., for Train002) and the features 90", 134", 138" (e.g., for Train003) are displayed for the other trains on that map 86.

EXAMPLE 7

FIG. 7 shows the train, track and roadway GIS map 86 for display on the GIS display 54 of FIG. 3. Overlaid with the track displays 150 of FIG. 7 are local maps 152 of roadways, along with suitable landmarks, such as 154, or other representations, such as canal 156, or names, such as 158, in order to identify certain locations 160 in the geographic area of interest 162.

EXAMPLE 8

The GIS 50 of FIG. 3 addresses emergency response issues as they directly affect or otherwise involve the rail industry. There are two primary areas to which the GIS 50 is applicable and where it will have the greatest impact. The first involves the railroads and the second is in the area of transit and commuter rail. In both cases, accurately knowing the near real-time positions of trains relative to geographic points, landmarks or thoroughfares is key. For the railroads, train location has an effect on emergency response times and routing due to railroad crossings. For transit and commuter rail, the primary focus is on train incidents and their locations.

An important aspect of the invention is the combination of information/communication subsystems along with access to train position information to strengthen the link (and improve relations) between civil/municipal authorities, particularly those in charge of emergency response, and the appropriate rail authorities and railroads. Furthermore, by employing web-based technologies for communication and low cost access to train position information, emergency response facilities can improve their operations by more effectively and efficiently responding to emergencies when these involve or are affected by railroads.

EXAMPLE 9

FIG. 8 shows an example of a plurality of layers in a GIS map, such as 86 of FIG. 7, of the GIS database 94. The train position layer GIS data 124 and the railroad layer GIS data 122 of FIG. 4 correspond to two layers 136 and 92, respectively, within the GIS map 86. That GIS map 86 includes a plurality of layers 164, 166, 92, 136, 168, each of which provides a type of information that can be added or removed from the GIS display 54 (FIG. 3) as desired.

The example GIS map 86 includes five layers: (1) landmark 164; (2) roadway 166; (3) railroad 92; (4) train position 136; and (5) label 168, as shown in FIG. 8. The landmark layer 164 contains any points of interest in the map area. The roadway layer 166 shows local roads and highways within the map area. The railroad layer 92 displays railroad tracks in the map area. The train position layer 136 sits below the label layer 168 and on top of all the other layers 164, 166, 92 and contains the current position of the trains in the viewing area. Unlike the other layers 164, 166, 92, 168, the train position layer 136 is dynamic and is updated each time a train moves within the viewing area. The label layer 168 displays string identifiers, such as train names 170.

Although five layers are shown in FIG. 8, only the current dynamic track occupancy (e.g., train location information of train position layer 136) and the static local track infrastructure of railroad layer 92 need to be displayed on the GIS display 54 of FIG. 3 if roadway data from layer 166 is not required. Otherwise, data from at least layers 136, 92 and 166 is employed.

Each one of the layers 164, 166, 92, 136, 168 is made of a number of GIS features. A feature can be a node, a line or an area.

A node represents an intersection point or the end point of a line. Each node is uniquely numbered and is located by a pair of XY geographical coordinate values. The transformation between geographical coordinate values (e.g., points 118 of FIG. 4) and XY points on a GIS display is accomplished using library functions provided by GIS vendor packages, such as, for example, Map Objects for Java marketed by ESRI of Redlands, Calif.; or MapXtreme Java Edition marketed by MapInfo of Rochester, N.Y.

Lines are also uniquely numbered. A line's geometry is described by a series of coordinate pairs. A straight line is defined by only two coordinate pairs (representing the beginning and the end of the line), whereas additional coordinate pairs are employed to represent curvilinear features. The more coordinate pairs that are employed, the more precise the geometric definition of the line.

Areas are bounded by one or more lines and may be identified by a centroid or another suitable point that is located anywhere within the area.

Figure 10:
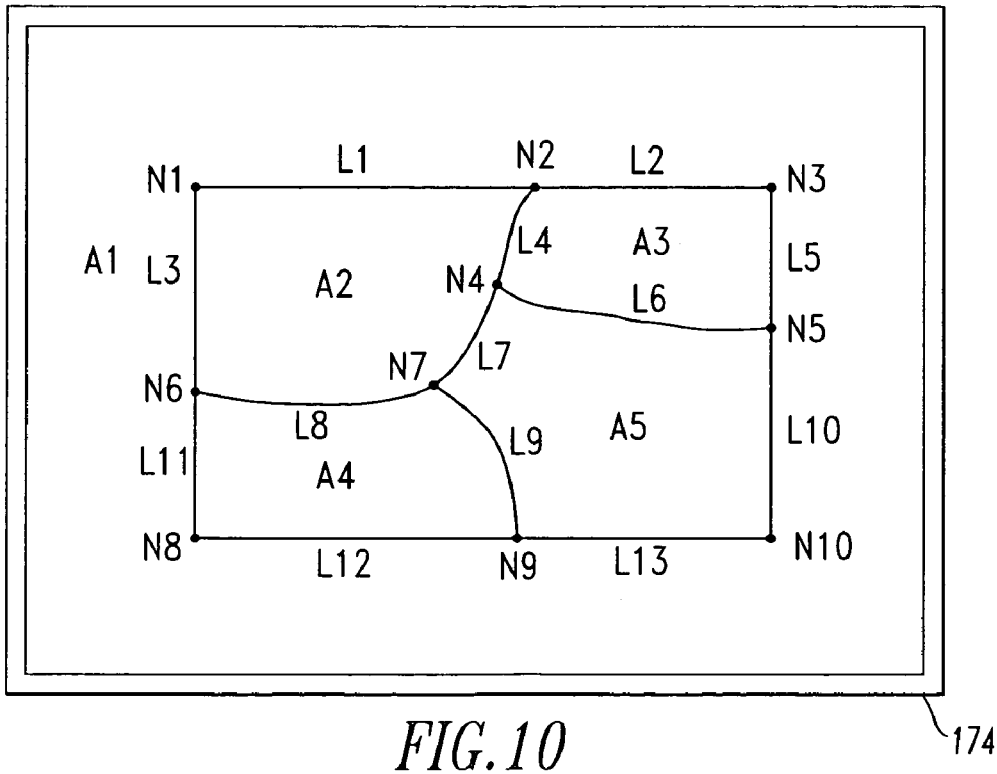
FIG. 10 PRIOR ART
FIG. 10 is a block diagram showing map topology of a GIS map for the GIS data files and records of FIG. 9.

FIGS. 9 and 10 show examples of GIS data files and records 172 and a corresponding map topology of a GIS map 174, respectively, for the roadway layer 166 of FIG. 8.

EXAMPLE 10

Because GIS displays, such as the GIS map 86 of FIG. 7, are accessible via, for example, wireless communication, devices like on-board laptops, hand-held electronics (e.g., PDAs) and other protocol-enabled devices may be employed to provide up-to-the-minute near real-time information about blocked routes and train locations even to vehicles already in transit to the emergency site. In other words, routing may be dynamically modified.

Preferably, in terms of low cost access, the Internet, and in particular, protocol-enabled technologies, provide the communication link between the rail authority and the emergency services of the civil authorities.

EXAMPLE 11

In the case of public transit, the number of users is far fewer. The GIS displays, such as GIS map 86, serve a different purpose than that intended for mainline railroads. For a heavy rail subway, for example, it may be desirable to show the location of transit lines relative to the street network above. This type of display may be static (e.g., track/street network only) or dynamic (e.g., with vehicle location). This may likely be used within a control center and not necessarily require web access.

EXAMPLE 12

Alternatively, any municipal agency, whether proximately located or not, may be given access to the GIS map(s).

EXAMPLE 13

A similar application may be applied to light rail transit (LRT), although this too would probably be utilized within a control center. Other information, such as emergency access and evacuation points, may be added.

EXAMPLE 14

Although not shown in FIG. 8, an additional layer may be added to correspond to dynamic vehicular traffic conditions. This improves the ability of civil authorities to respond to emergency situations because they would know the positions of trains and other vehicles in near real-time.

Since Sep. 11, 2001, the increased risk of disasters from malicious tampering for the purpose of destroying key facilities, railroads and transit systems in the vicinities of towns and cities warrants the need for an informed response system. In fact, the increased likelihood of such disasters may be the area in which the disclosed GIS 50 will have the greatest impact.

The disclosed GIS 50 provides a secure, easy-to-understand display of trackage in the vicinity of a particular municipality (e.g., railroad tracks running through a town) at an emergency dispatch center, thereby enabling emergency services to react more effectively to train position.

The disclosed GIS 50 displays train location in a specific block of track in near real-time on a GIS display 54 using a standard web browser interface. The easily understood display includes rail lines, highway, street and other civil information. This may be employed by emergency services (e.g., police; fire; medical) and other civil authorities to aid in the dispatch of emergency personnel and equipment and to improve emergency response time. Preferably, a secure system is employed, which is not easily accessible by unauthorized users. In the case of transit and commuter systems, civil authorities may respond more quickly to accidents or breakdowns in tunnels since they have the ability to locate trains. Hence, dispatchers immediately know where to send and how to route an emergency response team. This provides civil authorities with near real-time displays of train direction and accurate geographic location, in order that emergency vehicle dispatchers can more effectively route emergency vehicles around obstructed railroad crossings. Such a civil overview system may employ current, cleared and planned train movements on variable train routes and provide travel route mapping to civil authorities for selecting a route in view of such train movements, thereby allowing emergency vehicles to avoid congestion due to railroad traffic.

The present system and method may be employed by civil authorities to monitor railroad and transit operations in municipalities and congested areas, and by any other activity requiring near real-time knowledge of train locations.

The disclosed GIS 50 will have a significant impact on large railroad networks where there are a significant number of potential users (e.g., many hundreds) who are geographically dispersed, have no specialized computing equipment and are not directly connected to a CAD system.

Although GIS displays, such as 54, and a civil authority client, such as the PC 66, have been disclosed in connection with the display of geographic information, such as the GIS map 86, any suitable display may be employed. For example, such information may be stored, printed on hard copy, be computer modified, be combined with other data, or be transmitted for display elsewhere. All such processing shall be deemed to fall within the terms "display" or "displaying" as employed herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method for displaying geographic roadway data, geographic track data, and geographic position data for a train, said method comprising:

employing a geographic information system database;

entering static roadway data in said geographic information system database;

entering static track data in said geographic information system database;

controlling or monitoring a plurality of track sections with a plurality of track circuits;

determining a first track section of said track sections occupied by said train;

determining at least one second track section of said track sections, which has been cleared to be occupied by said train at a future time;

determining geographic starting and ending positions of said first track section;

determining geographic starting and ending positions of said at least one second track section;

displaying geographic information regarding said static roadway data and said static track data from said geographic information system database;

determining first geographic information regarding said first track section occupied by said train from said geographic starting and ending positions of said first track section and from said geographic information system database;

determining second geographic information regarding said at least one second track section from said geographic starting and ending positions of said at least one second track section and from said geographic information system database; and displaying said first and second geographic information regarding said first track section occupied by said train and said at least one second track section with said geographic information regarding said static roadway data and said static track data.

2. The method of claim 1 further comprising:

storing a starting longitude, a starting latitude, an ending longitude and an ending latitude for each of said track sections in another database;

determining said first geographic information regarding said first track section occupied by said train from said starting longitude, said starting latitude, said ending longitude and said ending latitude of said first track section occupied by said train and from said geographic information system database; and determining said second geographic information regarding said at least one second track section from said starting longitude, said starting latitude, said ending longitude and said ending latitude of each of said at least one second track section from said geographic information system database.

3. The method of claim 2 further comprising:

determining a plurality of third nodes between a first node defined by said starting longitude and said starting latitude of said first track section occupied by said train and a second node defined by said ending longitude and said ending latitude of said first track section occupied by said train from said geographic information system database;

displaying a plurality of first lines between said third nodes as said first geographic information regarding said first track section occupied by said train;

determining a plurality of sixth nodes between a fourth node defined by said starting longitude and said starting latitude of a first one of said at least one second track section and a fifth node defined by said ending longitude and said ending latitude of a last one of said at least one second track section from said geographic information system database; and displaying a plurality of second lines between said sixth nodes as said second geographic information regarding said at least one second track section.

4. The method of claim 1 further comprising:

entering said determined first geographic information regarding said first track section occupied by said train in said geographic information system database before said displaying said first geographic information regarding said first track section occupied by said train.

5. The method of claim 1 further comprising:

determining another track section occupied by said train;

determining geographic starting and ending positions of said another track section;

determining geographic information regarding said another track section occupied by said train from said geographic starting and ending positions of said another track section and from said geographic information system database; and displaying said geographic information regarding said another track section occupied by said train.

6. The method of claim 5 further comprising:

responding to an event defined by said determining another track section occupied by said train; and continuously displaying in about real-time said geographic information regarding said another track section occupied by said train.

7. The method of claim 1 further comprising:

clearing another track section of said track sections to be occupied by said train;

determining as a cleared track section said another track section;

determining geographic starting and ending positions of said cleared track section;

determining geographic information regarding said cleared track section from said geographic starting and ending positions of said cleared track section and from said geographic information system database; and displaying said geographic information regarding said cleared track section with said displayed first geographic information regarding said first track section occupied by said train.

8. The method of claim 7 further comprising:

displaying said first geographic information regarding said first track section occupied by said train in a first color; and displaying said geographic information regarding said cleared track section in a second different color.

9. The method of claim 7 further comprising:

planning at least one third track section of said track sections to be occupied by said train;

determining as at least one planned track section said at least one third track section of said track sections to be occupied by said train;

determining geographic starting and ending positions of said at least one planned track section;

determining geographic information regarding said at least one planned track section from said geographic starting and ending positions of said at least one planned track section and from said geographic information system database; and displaying said geographic information regarding said at least one planned track section with said displayed first geographic information regarding said first track section occupied by said train and with said displayed geographic information regarding said cleared track section.

10. The method of claim 9 further comprising:

displaying said first geographic information regarding said first track section occupied by said train in a first color;

displaying said geographic information regarding said cleared track section in a second different color; and displaying said geographic information regarding said planned track section in a third different color.

11. The method of claim 1 further comprising:

including with said geographic information system database a roadway layer and a railroad layer;

entering said static roadway data in said roadway layer of said geographic information system database; and entering said static track data in said railroad layer of said geographic information system database.

12. The method of claim 11 further comprising:

including with said geographic information system database a train position layer; and dynamically determining said first geographic information regarding said first track section occupied by said train; and entering said dynamically determined first geographic information in said train position layer of said geographic information system database.

13. The method of claim 12 further comprising:

including with said geographic information system database at least one of a label layer and a landmark layer.

14. The method of claim 12 further comprising:

determining when said train moves within a geographic area corresponding to said train position layer of said geographic information system database and responsively entering said dynamically determined first geographic information in said train position layer of said geographic information system database.

15. The method of claim 1 further comprising:

employing said static roadway data for a predetermined municipality.

16. The method of claim 1 further comprising:

determining said first track section occupied by said train from a computer aided dispatching system.

17. The method of claim 1 further comprising:

determining said first track section occupied by said train at a present time.

18. The method of claim 1 further comprising determining as a planned track section a further track section planned to be occupied by said train at another future time; and displaying geographic information regarding said planned track section with said first and second geographic information regarding said first track section occupied by said train and said at least one second track section.

19. The method of claim 1 further comprising:

overlaying said displayed geographic information regarding said static roadway data and said static track data from said geographic information system database with said displayed first and second geographic information regarding said first track section occupied by said train and said at least one second track section.

20. The method of claim 1 further comprising:

employing with said displayed geographic information regarding said static roadway data at least one of a map of roadways, and a plurality of representations of location identifiers.

21. The method of claim 20 further comprising:

employing a plurality of names as said representations of location identifiers.

22. The method of claim 1 further comprising:

employing said train as a first train;

determining said first track section occupied by said first train and a third track section of said track sections occupied by a second train from a computer aided dispatching system;

determining geographic starting and ending positions of said third track section;

determining geographic information regarding said third track section occupied by said second train from said geographic starting and ending positions of said third track section and from said geographic information system database; and displaying said geographic information regarding said first and third track sections occupied by said first and second trains, respectively, with said geographic information regarding said static roadway data and said static track data.

23. A geographic information system for displaying geographic roadway data, geographic track data, and geographic position data for a train, said geographic information system comprising:

a geographic information system database including static roadway data and static track data;

means for determining a first track section occupied by said train from a plurality of track sections, which are controlled or monitored with a plurality of track circuits;

means for determining at least one second track section of said track sections, which has been cleared to be occupied by said train at a future time;

means for determining geographic starting and ending positions of said first track section;

means for determining geographic starting and ending positions of said at least one second track section;

means for displaying geographic information regarding said static roadway data and said static track data from said geographic information system database;

means for determining first geographic information regarding said first track section occupied by said train from said geographic starting and ending positions of said first track section and from said geographic information system database;

means for determining second geographic information regarding said at least one second track section from said geographic starting and ending positions of said at least one second track section and from said geographic information system database; and means for displaying said first and second geographic information regarding said first track section occupied by said train and said at least one second track section with said geographic information regarding said static roadway data and said static track data.

24. The system of claim 23 wherein said means for determining a first track section occupied by said train is a computer aided dispatching system; and wherein said means for determining geographic starting and ending positions of said first track section includes a track infrastructure database.

25. The system of claim 24 wherein said means for determining geographic starting and ending positions of said first track section further includes a translation routine; wherein said track infrastructure database includes a plurality of records, with one of said records being associated with a corresponding one of said track sections, and further includes with each of said records a record identifier, an identifier of said corresponding one of said track sections, a starting latitude, a starting longitude, an ending latitude and an ending longitude; wherein said computer aided dispatching system sends a message including an identifier of said first track section to said translation routine; and wherein said translation routine responsively employs said identifier as a key to find one of said records in said track infrastructure database.

26. The system of claim 25 wherein the static track data of said geographic information system database includes a plurality of representations of railroad tracks; wherein said means for displaying geographic information regarding said static roadway data and said static track data includes an image generator routine to display said static roadway data and said representations of railroad tracks; wherein said means for determining first geographic information regarding said first track section occupied by said train includes a train position routine, which receives from said translation routine said starting latitude, said starting longitude, said ending latitude and said ending longitude and responsively determines at least one of said representations of railroad tracks from said static track data of said geographic information system database; and wherein said means for displaying said first and second geographic information regarding said first track section occupied by said train and said at least one second track section displays a feature associated with said at least one of said representations of railroad tracks.

27. The system of claim 26 wherein said geographic information system database includes a plurality of geographic information system maps associated with a plurality of corresponding geographic areas; and wherein said train position routine employs said starting latitude, said starting longitude, said ending latitude and said ending longitude to select one of said geographic information system maps on which to display said feature associated with said at least one of said representations of railroad tracks.

28. The system of claim 27 wherein said means for displaying said first and second geographic information regarding said first track section occupied by said train and said at least one second track section includes a global communication network, a web browser and a display applet; and wherein said train position routine stores said feature in said geographic information system database and outputs a streaming vector corresponding to said feature over said global communication network to said display applet.

29. The system of claim 28 wherein said display applet receives said streaming vector and displays a representation of said feature on a geographic information system map display.

30. The system of claim 28 wherein said translation routine and said train position routine are part of a server; and wherein said web browser and said display applet are part of a client, which is interconnected with said server by said global communication network.

* * * * *

UNITED STATES PATENT AND TRADEMARK OFFICE

CERTIFICATE OF CORRECTION

PATENT NO. : 7,395,140 B2
APPLICATION NO. : 10/789593
DATED : July 1, 2008
INVENTOR(S) : W. Brian Christie et al.

It is certified that error appears in the above-identified patent and that said Letters Patent is hereby corrected as shown below:

On the Title Page, second column, under OTHER PUBLICATIONS, "http://www.vre.org.trainbrain/disrupt.shtml" should be --http://www.vre.org/trainbrain/disrupt.shtml--.

Column 8, line 33, "(e.g., 0xC0000A in this example)" should be --(e.g., 0x1C0000A in this example)--.

Signed and Sealed this

Fifth Day of May, 2009

John Doll

JOHN DOLL
*Acting Director of the United States Patent and Trademark Office*